US008013533B2

(12) United States Patent
De Rijck et al.

(10) Patent No.: US 8,013,533 B2
(45) Date of Patent: Sep. 6, 2011

(54) METHOD AND DRIVER FOR DETERMINING DRIVE VALUES FOR DRIVING A LIGHTING DEVICE

(75) Inventors: Alexander Christiaan De Rijck, Eindhoven (NL); Roel Van Woudenberg, Eindhoven (NL); Henricus Marie Peeters, Eindhoven (NL); Peter Hubertus Franciscus Deurenberg, S Hertogenbosch (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 293 days.

(21) Appl. No.: 12/513,520

(22) PCT Filed: Nov. 6, 2007

(86) PCT No.: PCT/IB2007/054494

§ 371 (c)(1),
(2), (4) Date: May 5, 2009

(87) PCT Pub. No.: WO2008/056321

PCT Pub. Date: May 15, 2008

(65) Prior Publication Data

US 2010/0072901 A1 Mar. 25, 2010

(30) Foreign Application Priority Data

Nov. 10, 2006 (EP) ..... 06123822

(51) Int. Cl.
*H05B 37/02* (2006.01)
*H05B 39/04* (2006.01)
*H05B 41/36* (2006.01)

(52) U.S. Cl. ..... 315/149; 315/151; 315/156; 315/291

(58) Field of Classification Search ..... None
See application file for complete search history.

(56) References Cited

U.S. PATENT DOCUMENTS 6,441,558 B1 * 8/2002 Muthu et al. ..... 315/149
7,696,964 B2 * 4/2010 Lankhorst et al. ..... 345/82
(Continued)

FOREIGN PATENT DOCUMENTS

DE 102004023186 A1 12/2005
WO 2006069002 A2 6/2006

OTHER PUBLICATIONS

Coelen et al: "Color Tunable LED Spot Lighting"; Presented at SPIE Conference, 2006, Proceedings of the SPIE, vol. 6337, 15 Page Document.

*Primary Examiner* — Anh Q Tran

(57) ABSTRACT

The present invention relates to a method for determining drive values for driving a lighting device at a desired brightness and color. The method comprising the steps of determining a first luminous flux weight ratio based on the desired color and a first drive current for driving each of the differently colored LEDs, determining a first luminous flux for each of the differently colored LEDs based on the desired brightness and the first luminous flux weight ratio, comparing, for each of the differently colored LEDs, the first luminous flux with a nominal luminous flux for a plurality of different drive currents, selecting, for each of the differently colored LEDs, a preferred drive current that at least can produce the first luminous flux, determining a second luminous flux weight ratio based on the desired color and the selected drive currents for each of the differently colored LEDs, determining a second luminous flux for each of the differently colored LEDs based on the desired brightness and the second luminous flux weight ratio, and determining a duty cycle for each of the differently colored LEDs at the selected drive currents, wherein the selected currents at the determined duty cycles produces the second luminous flux for each of the differently colored LEDs. The present invention provides for the possibility to limit the number of necessary computational steps for determining preferred drive currents. Furthermore, an increase in number of current level and/or differently colored LEDs would only slightly increase the computational cost.

12 Claims, 4 Drawing Sheets

U.S. PATENT DOCUMENTS

2003/0214242 A1 11/2003 Berg-Johansen
2004/0066652 A1 4/2004 Hong
2004/0160199 A1 8/2004 Morgan et al.
2006/0033443 A1 2/2006 Ishii et al.
2006/0221637 A1 10/2006 Chikugawa et al.
2010/0264834 A1* 10/2010 Gaines et al. ..... 315/152

* cited by examiner

METHOD AND DRIVER FOR DETERMINING DRIVE VALUES FOR DRIVING A LIGHTING DEVICE

FIELD OF THE INVENTION

The present invention relates to a method for determining drive values for driving a lighting device at a desired brightness and color. The present invention also relates to a corresponding driver for determining drive values for driving a lighting device.

DESCRIPTION OF THE RELATED ART

Recently, much progress has been made in increasing the brightness of light emitting diodes (LEDs). As a result, LEDs have become sufficiently bright and inexpensive to serve as a light source in for example lighting system such as lamps with adjustable color, direct view Liquid Crystal Displays (LCDs), and in front and rear projection displays.

By mixing differently colored LEDs any number of colors can be generated, e.g. white. An adjustable color lighting system is typically constructed by using a number of primary colors, and in one example, the three primaries red, green and blue are used. The color of the generated light is determined by which of the LEDs that are used, as well as by the mixing ratios. To generate "white", all three LED colors have to be turned on with the right mixing ratio.

LED lighting systems generally employ regulated power sources for supplying power to the LEDs. In the art of LED drivers, it is known to control LEDs using a pulse-width modulated (PWM) drive current as a power source to the LED. Pulse width modulation (PWM) involves supplying a substantially constant current to the LEDs for particular periods of time. The shorter the time, or pulse-width, the less brightness an observer will observe in the resulting light. The human eye integrates the light it receives over a period of time and, even though the current through the LEDs may generate the same light level regardless of pulse duration, the eye will perceive short pulses as "dimmer" than longer pulses.

A disadvantage of using only PWM is that the LED is always used at the same current level, which may not be the most efficient current level, meaning that the power is wasted to generate light. A more efficient way to drive the LED's for brightness control is to introduce more than one current level at which the LED's can be driven with the PWM. Typical LED performance characteristics depend on the amount of current drawn by the LED. The optimal efficiency may be obtained at a lower current than the level where maximum brightness occurs. LEDs are typically driven well above their most efficient operating current to increase the brightness delivered by the LED while maintaining a reasonable life expectancy. As a result, increased efficiency can be provided when the maximum current value of the PWM signal may be variable. For example, if the desired light output is less than the maximum required output, the current and/or the PWM signal width may be reduced.

An example of a system for controlling the brightness of a plurality of white LEDs is disclosed in US 2003/021 42 42 A1. In the disclosed system, the LEDs are arranged as a backlight for a display, such as a liquid crystal display (LCD). During operation, the brightness of the backlight is controlled by pulse width modulation and by subdividing the reference drive voltage for driving the backlight into a large plurality of discrete levels by means of a D/A converter. However, such a system is not suitable for driving a lighting device comprising of a plurality of differently colored LEDs since a shift in amplitude also results in a significant color shift.

OBJECT OF THE INVENTION

There is therefore a need for an improved method for determining drive values for driving a lighting device at a desired brightness and color, and more specifically that overcome or at least alleviates the problem with color shift when driving a lighting device comprising of a plurality of LEDs of at least two colors at multiple current amplitude levels.

SUMMARY OF THE INVENTION

The above object is met by a novel method for determining drive values for driving a lighting device at a desired brightness and color as defined in claim 1, and a corresponding driver for determining drive values for driving a lighting device as defined in claim 8. The appended sub-claims define advantageous embodiments in accordance with the present invention.

According to an aspect of the invention, there is provided a method for determining drive values for driving a lighting device at a desired brightness and color, said lighting device comprising of a plurality of light emitting diodes (LEDs) of at least two different colors, said method comprising the steps of determining a first luminous flux weight ratio based on the desired color and a first drive current for driving each of the differently colored LEDs, determining a first luminous flux for each of the differently colored LEDs based on the desired brightness and the first luminous flux weight ratio, comparing, for each of the differently colored LEDs, the first luminous flux with a nominal luminous flux for a plurality of different drive currents, selecting, for each of the differently colored LEDs, a preferred drive current that at least can produce the first luminous flux, determining a second luminous flux weight ratio based on the desired color and the selected drive currents for each of the differently colored LEDs, determining a second luminous flux for each of the differently colored LEDs based on the desired brightness and the second luminous flux weight ratio, and determining a duty cycle for each of the differently colored LEDs at the selected drive currents, wherein the selected currents at the determined duty cycles produces the second luminous flux for each of the differently colored LEDs.

The differently colored LEDs preferably includes at least a red narrow banded light emitting diode, at least a green narrow banded light emitting diode, and at least a blue narrow banded light emitting diode. However, the skilled addressee realizes that it also would be possible to use other types of light sources such as organic light emitting diodes (OLEDs), polymeric light emitting diodes (PLEDs), inorganic LEDs, lasers, or a combination thereof, as well as a wide-band (direct or phosphor converted) LED and wide-band (phosphor converted) white LEDs. An advantage with using narrow banded LEDs in a lighting device as described above is that it is possible to generate saturated colors. However, the skilled addressee realizes that a wide-band LED also can give a saturated color Furthermore, it should be noted that the invention is not only useful to "single-colors" such as just described, but can also be used with for example multiple variants of white LEDs (e.g. cool white, warm white, and a combination of the two whites which can make a color point tunable lamp with different color temperatures of white; also combinations of white LEDs with single-color LEDs for color point adjustment are possible).

As described above, the color (i.e. the wavelength) produced by a LED depends on the current level/amplitude used to drive the LED. Hence, when determining drive values for driving the lighting device to emit light at a desired brightness and color, it is according to the present invention preferred to select a first drive current level, preferably the highest specified drive current for each of the LEDs, at which the color is known, and then based on the produced color for each of the LEDs determine a luminous flux weight ratio that correspond to the desired color through for example a color space conversion (e.g. CIE to RGB color space conversion). It might however also be possible to select the drive currents that produces the largest possible color gamut.

Based on the luminous flux weight ratio and the desired luminance, it is possible to determine a luminous flux for each of the LEDs at the first drive current level. This luminous flux for each of the LEDs is then compared to a luminous flux interval, i.e. nominal level, which can be produced at each of a predetermined limited number of different drive currents. Out of this limited number of different drive currents a preferred drive current is selected that at least can produce the first luminous flux.

However, if the preferred drive current differs from the first drive current, it is necessary to perform a recalculation of the luminous flux weight ratio, e.g. determine a second luminous flux weight ratio based on the desired color and the newly selected drive currents for each of the LEDs. This is due to the color shift which will occur when selecting a different drive current than the first drive current.

Based on this second luminous flux weight ratio and the desired color, it is according to the present invention possible to determine a second luminous flux for each of the differently colored LEDs, and based on that second luminous flux and the desired brightness determine corresponding duty cycles that at the selected currents produces the second luminous flux for each of the differently colored LEDs.

According to prior art, the process of determining drive values for driving a lighting device at a desired color and brightness, where the light emitted by the lighting device is produced by a plurality of differently colored LEDs, did not take into account the color shift produced when using a different current drive level then the first drive current level. However, the present invention provides for the possibility to limit the number of necessary computational steps for determining preferred drive currents. Furthermore, an increased number of current level and/or differently colored LEDs would only slightly increase the computational cost. An advantage with the present invention is that it is possible to select the appropriate drive currents and duty cycles in a forward manner, without the need for a feedback control system. It is however of course possible to include such a feedback control system. Another advantage is that the current through the LEDs are minimized which relaxes the timing and signal integrity requirements as well as prolonging the life time of the LEDs due to a lower substrate temperature (a higher drive current amplitude gives a higher substrate temperature of the LED).

Generally, the selected drive currents and the determined duty cycles are used to drive each of the differently colored LEDs such that the lighting device produces the desired color and brightness. However, as understood by the skilled addressee, the selected drive currents and the determined duty cycles might produce a color and brightness that slightly differs from the desired values. This difference might depend on aging of the LEDs and/or the surrounding temperature of the LEDs which might result in a color shift.

In an embodiment, the method further comprises the steps of acquiring measurement values by means of a temperature sensor mounted in proximity to the differently colored LEDs, determining a luminous flux and color for each of the differently colored LEDs based on said measurement values, determining a brightness and color for the lighting device based on said determined luminous fluxes and colors, and adjusting the drive currents and the duty cycles for each of said differently colored LEDs based on a difference between said desired brightness and color and the determined brightness and color such that the lighting device emits light at the desired brightness and color.

It may also be possible to acquire measurement values by means of a light sensing unit, and adjust at least one of the drive currents and the duty cycles for at least one the differently colored LEDs based on a difference between the desired brightness and color and the determined brightness and color such that the lighting device emits light at the desired brightness and color. Preferably, the light sensing unit comprises one of a flux sensor and/or a color sensor.

The plurality of different drive currents for driving each of the differently colored LEDs are preferably provided by activating a first current source to generate a first drive signal having a first amplitude, activating a second current source to generate a second drive having a second amplitude, adding the first drive signal to the second drive signal, thereby generating a composite drive signal, and providing the composite drive signal to each of the differently colored LEDs, wherein the composite drive signal can assume one out of four different amplitudes based on if one, both, or none of the current sources are activated.

Preferably, the second amplitude is lower than the first amplitude, but not necessarily half of the first amplitude as in comparison to a normal implementation of a D/A-converter where the first amplitude is an integer multiple of the second amplitude. For example, in a normal two-bit D/A converter the output from the D/A-converter would be provided in the steps of 0.0, ⅓, ⅔, and 1.0 of the maximum output of the D/A-converter. The above described implementation with two current sources could for example have a composite drive signal with an arbitrary output, such as for example 0.0, 0.38, 0.62, and 1.0 of the maximum output. However, it should be noted that it could for some applications be enough to have just 3 levels: 0, 0.5 and 1.0: in that case, one can either switch between two current sources, or add two sources of the same level (e.g. 2×0.5).

Each of the current sources can be activated with an individual pulse width modulated signal. In this way, the PWM activation signals are used for Pulse Width Modulation (PWM) and Pulse Amplitude Modulation (PAM) at the same time, keeping the implementation very simple. Only two current sources are used above, however, the skilled addressee recognizes that the implementation can be further expanded, where N current sources generates $2^N$ current levels.

According to another aspect, there is provided a driver for determining drive values for driving a lighting device at a desired brightness and color, said light emitting device comprising of a plurality of differently colored light emitting diodes (LEDs), said driver comprising means for determining a first luminous flux weight ratio based on the desired color and a first drive current for driving each of the differently colored LEDs, means for determining a first luminous flux for each of the differently colored LEDs based on the desired brightness and the first luminous flux weight ratio, means for comparing, for each of the differently colored LEDs, the first luminous flux with a nominal luminous flux for a plurality of different drive currents, means for selecting, for each of the differently colored LEDs, a preferred drive current that at least can produce the first luminous flux, means for determining a second luminous flux weight ratio based on the desired color and the selected drive currents for each of the differently colored LEDs, means for determining a second luminous flux for each of the differently colored LEDs based on the desired brightness and the second luminous flux weight ratio, and means for determining a duty cycle for each of the differently colored LEDs at the selected drive currents, wherein the selected currents at the determined duty cycles produces the second luminous flux for each of the differently colored LEDs. The advantages of the second aspect of the present invention are essentially the same as those of the first aspect.

The driver describe above is advantageously used as a component in for example, but not limited to, a display unit further comprising a display panel and a backlight comprising a lighting device comprising of a plurality of differently colored LEDs. The display panel can for example be a direct-view LCD (liquid crystal display) or an LCD-projector for TV application and/or monitor application.

BRIEF DESCRIPTION OF THE DRAWINGS

These and other aspects of the present invention will now be described in more detail, with reference to the appended drawings showing currently preferred embodiments of the invention, in which.

DETAILED DESCRIPTION OF CURRENTLY PREFERRED EMBODIMENTS

The present invention will now be described more fully hereinafter with reference to the accompanying drawings, in which currently preferred embodiments of the invention are shown. This invention may, however, be embodied in many different forms and should not be construed as limited to the embodiments set forth herein; rather, theses embodiment are provided for thoroughness and completeness, and fully convey the scope of the invention to the skilled addressee. Like numbers refer to like elements throughout.

Figure 1:
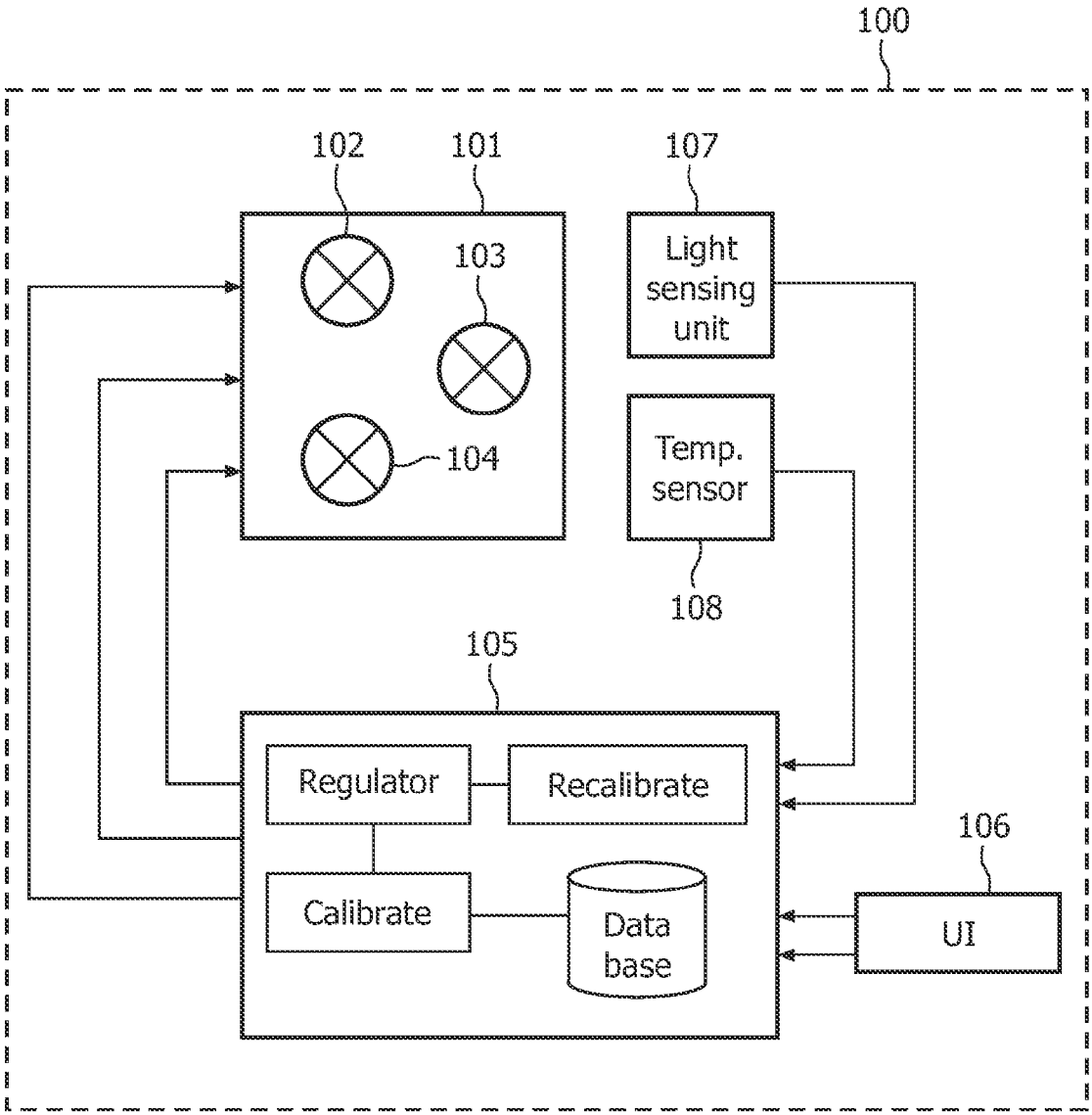
FIG. 1 is a block diagram showing an adjustable color illumination system according to an embodiment of the present invention.

Referring now to the drawings and to FIG. 1 in particular, there is depicted a block diagram of an adjustable color illumination system 100, arranged in accordance with a currently preferred embodiment of the present invention. In the exemplary embodiment, the illumination system 100 comprises a lighting device 101 comprising of three differently colored light emitting diodes of the colors red 102, green 103 and blue 104. The lighting device 101 is in turn connected to a driver, for example in the form of a controller 105, which is adapted to determine drive values for the LEDs 102-104 based on a desired color and brightness provided by a user through a user interface 106. The controller is further adapted to drive the lighting device 101 with the determined drive values. The user interface 106 may be connected to the controller 105 either by a wired or a wireless connection. The controller 105 is able to perform functions for determination, calibration, re-calculation, and to perform database queries (for example using a look-up table). These functions are further explained below in relation to FIGS. 2 and 3.

As understood by the skilled addressee, it is of course possible to use more that three differently colored light sources. Furthermore, it should be noted that any combination of LED colors can produce a gamut of colors, whether the LEDs are red, green, blue, amber, white, orange, UV, or other colors. The various embodiments described throughout this specification encompass all possible combinations of LEDs comprised in the lighting device, so that light of varying color, intensity, saturation and color temperature can be produced on demand under control of the controller 105.

The adjustable color illumination system 100 further comprises a light sensing unit 107 arranged such that light from all three LEDs will impinge on the light sensing unit 107, and a temperature sensor 108 arranged in the vicinity of the lighting device 101 and adapted to measure a surrounding temperature and/or a substrate temperature of the LEDs 102-104. The measurement results form the light sensing unit 107 and the temperature sensor 108 are provided to the controller 105. The light sensing unit 107 can comprise of a flux sensor and/or a color sensor. A flux sensor is a sensor that gives a single flux number, and is thus used with a drive- and measurement scheme which allows to determine red, green and blue fluxes separately. The sensor sensitivity preferably resembles the human eye sensitivity. A color sensor is a sensor that gives the color coordinates (e.g. CIE X,Y) of the light, and thus measuring the color coordinate of the resulting white or the individual R/G/B colors.

The controller 105 may include a microprocessor, microcontroller, programmable digital signal processor or another programmable device. The controller 105 may also, or instead, include an application specific integrated circuit, programmable gate array programmable array logic, a programmable logic device, or a digital signal processor. Where the controller 105 includes a programmable device such as the microprocessor or microcontroller mentioned above, the processor may further include computer executable code that controls operation of the programmable device.

The user interface 106 may include user input devices, such as buttons and adjustable controls, which produce a signal or voltage to be read by the controller 105. The voltage may be a digital signal corresponding to a high and a low digital state. If the voltage is in the form of an analog voltage, an analog to digital converter (A/D) may be used to convert the voltage into a useable digital form. The output from the A/D would then supply the controller 105 with a digital signal.

Figure 2:
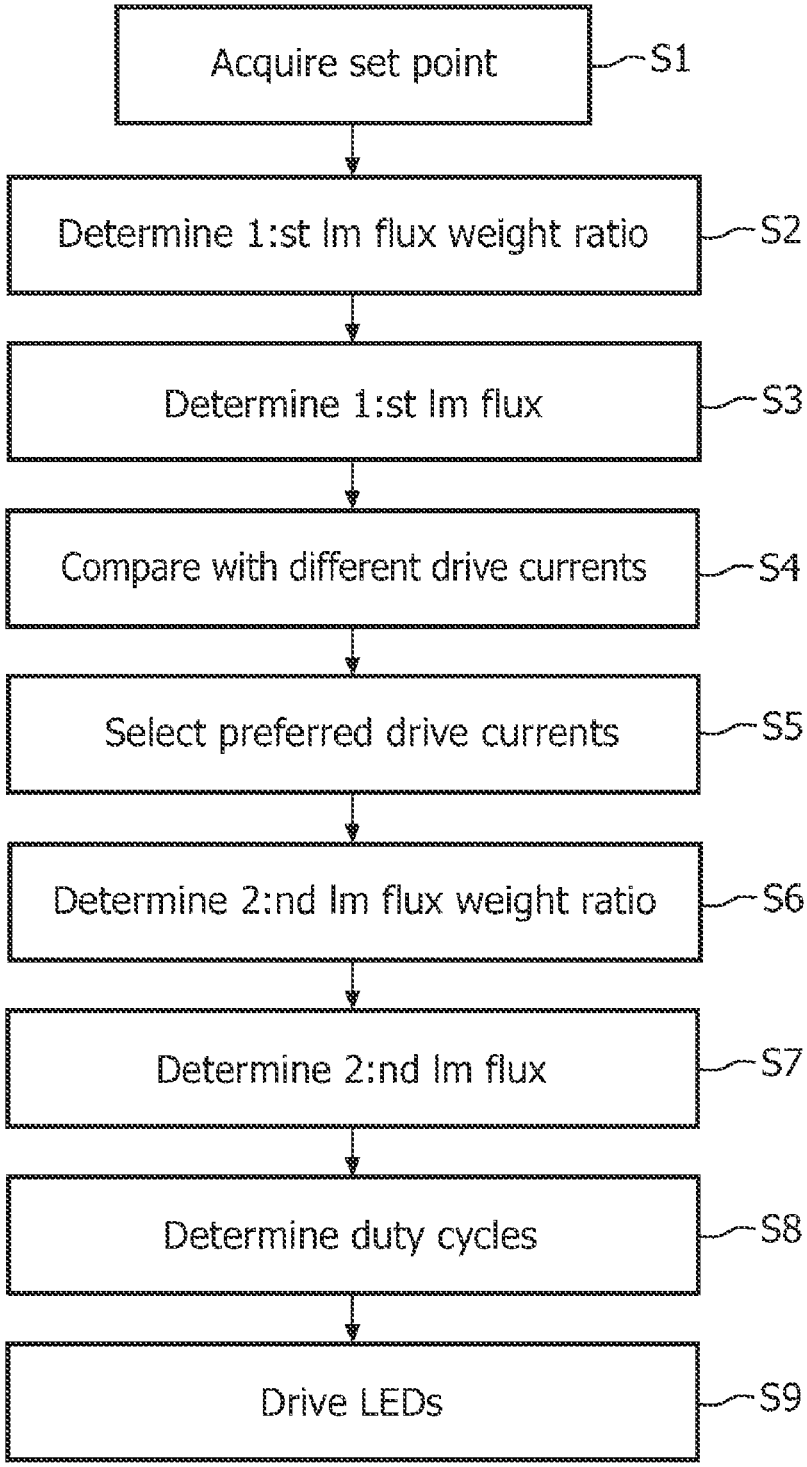
FIG. 2 is a flow chart showing the steps of the present invention.
Figure 3:
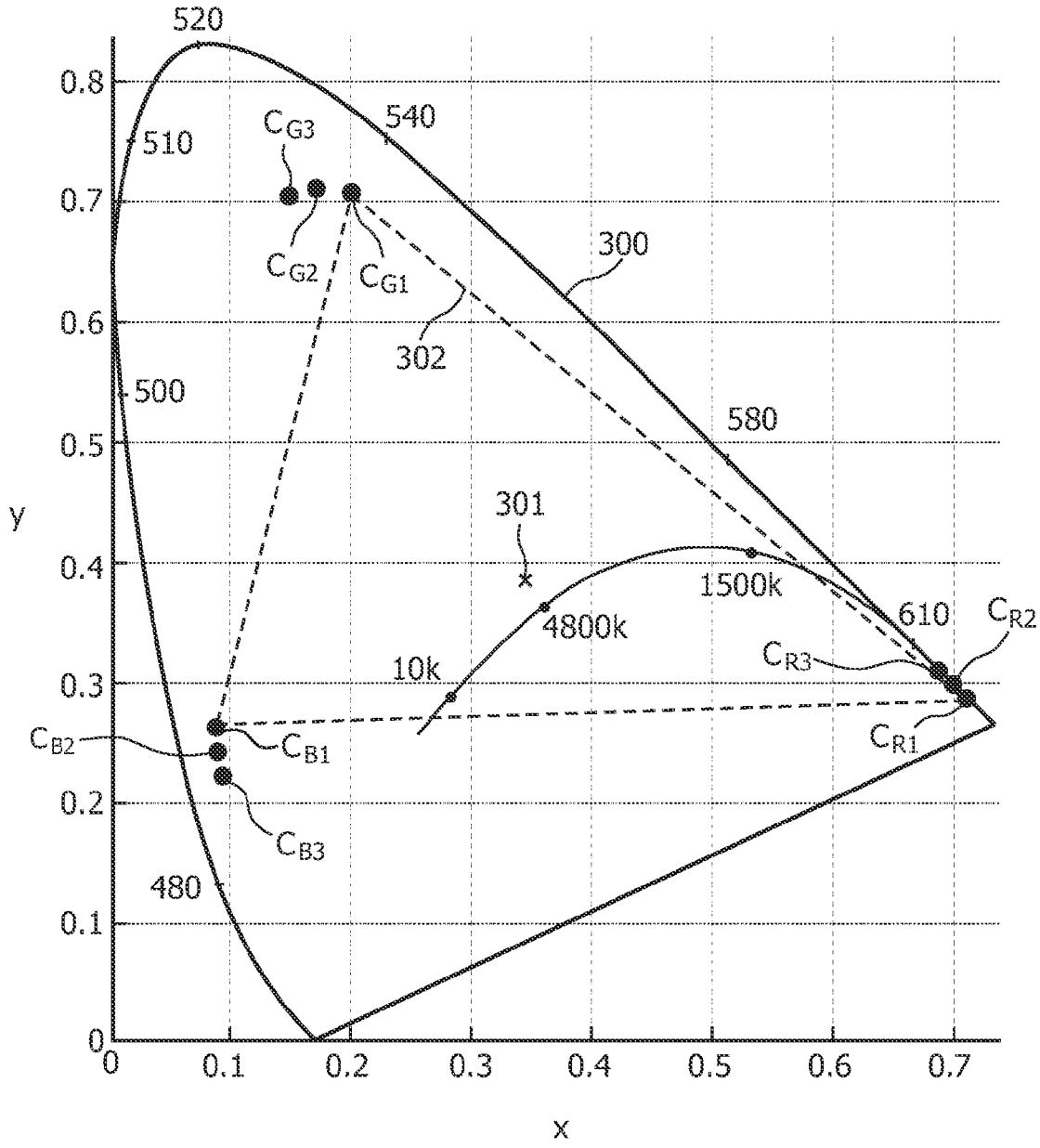
FIG. 3 is a CIE color space chromaticity diagram showing color points for three LEDs driven at three different current levels.

The method steps of a currently preferred embodiment of the present invention will be explained with references to FIG. 2 showing a flowchart, and FIG. 3 which illustrates a CIE (International Commission on Illumination) color space chromaticity diagram showing color points, $C_{R1\text{-}3}$, $C_{G1\text{-}3}$ and $C_{B1\text{-}3}$ for the differently colored LEDs from FIG. 1 when driven at three different current levels. In FIG. 3, the outer horseshoe-shaped curve 300 corresponds to the colors of the visible spectrum (color points of monochromatic light).

The steps of the present invention is explained by means of an example in which initially a user in a first step S1 selects a desired color and a desired brightness (i.e. a set point representing total brightness and total color) by means of the user interface 106. In the present embodiment, the user has selected a white color point which is represented by color point 301 in FIG. 3. The skilled addressee realizes that the desired color and a desired brightness in another embodiment may be selected by means of for example another electrical system. An example of such an embodiment could be where the method according to the present invention is used to control a lighting device in a backlight comprised together with a display panel in a display unit. In this case, the desired color and brightness might be provided by means of the images that are intended to be displayed on the display unit.

In step S2 the controller 105 receives the desired color and brightness and determines, based on the desired color and a first drive current for driving each of the differently colored LEDs, a first luminous flux weight ratio. In FIG. 3, the corresponding color point for each of the differently colored LEDs at the first drive current is denoted with $C_{R1}$, $C_{G1}$, and $C_{B1}$. As can be seen in the diagram in FIG. 3, the three color points $C_{R1}$, $C_{G1}$, and $C_{B1}$ forms a triangle 301 that surrounds the color point 301 selected by the user, hence it is possible to generate the user selected color point 301 by turning on all three LEDs 102-104 with the first drive current, which generally is the drive current that produces the largest possible overall light output. This current level is normally the highest allowed current level for the LEDs; however, it would be possible to use another arbitrary current level. For example, for a display to have the largest possible color gamut, the current levels with the largest possible "color triangle" could be used as the first currents.

The first luminous flux weight ratio is determined by performing a color space conversion, for example a CIE to RGB color space conversion. This conversion may be completed by using a look-up table or by performing a matrix calculation, processes which are well known in the art.

Based on the first luminous flux weight ratio, which for example can be described as:

$$\text{luminous flux weight ratio}=A^*\text{red}+B^*\text{blue}+C^*\text{green}$$

where A+B+C=1 it is possible to determine, in step S3, a first luminous flux for each of the differently colored LEDs based on the desired brightness and the first luminous flux weight ratio.

The first luminous flux for each of the differently colored LEDs are then in step S4 compared with a nominal luminous flux for a plurality of different drive currents having corresponding different color points. In FIG. 3, two different drive currents are represented by two additional color points for each of the differently colored LEDs, i.e. $C_{R2\text{-}3}$, $C_{G2\text{-}3}$ and $C_{B2\text{-}3}$. As is illustrated in FIG. 3, the color of the individual LED outputs changes (to longer wavelengths when the current goes up) and the relative light output level of differently colored LEDs changes causing the color of the mixed light, for example white light, to drift away when the same mix ratios are used.

In step S5 a preferred drive current is selected that at least can produce the first luminous flux. As described above, it is necessary that the corresponding color points for those preferred drives together forms a triangle that surrounds the color point 301 selected by the user.

If the selected drive currents are different from the first drive currents for each of the differently colored LEDs, it is necessary to determine, in step S6, a second luminous flux weight ratio based on the desired color and the selected drive currents for each of the differently colored LEDs. This is due to the fact that different drive currents will generate a color shift, i.e. the color point is positioned differently in the CIE color space diagram, in comparison to the color emitted by the LEDs at the first drive currents.

Based on the new, second, luminous flux weight ratio and the desired brightness, a second luminous flux for each of the differently colored LEDs is determined in step S7. This step is generally executed in a similar manner as step S3 above.

To be able to produce light at the determined second luminous flux for each of the differently colored LEDs, a duty cycle for each of the differently colored LEDs at the selected drive currents is determined in step S8. A duty cycle of less than 100% will provide for a dimming of the LEDs, i.e. the LEDs will emit light with a perceived lower brightness. The selected drive currents at the determined duty cycles will produces the second luminous flux for each of the differently colored LEDs.

Finally, in step S9, each of the differently colored LEDs are driven with the selected currents at the determined duty cycles such that the lighting device 101 emits light at the color and brightness selected by the user.

However, as understood by the skilled addressee, aging and temperature changes, such as differences in the surrounding temperature and/or the substrate temperature in comparison to a predetermined normal temperature, will also render a shift in color. It might therefore be necessary to further regulate the duty cycle, and even the selected current levels of at least one of the differently colored LEDs.

A feedback signal for such a control system is provided by means of the light sensing unit 107. If a flux sensor is used, the measurement values are converted to a corresponding color point for each of the LEDs and compared to the earlier calculated color points. However, if a color sensor is used, its readings can be directly applied. If the difference is greater than a first predetermined threshold, the duty cycle of the selected drive currents that are provided to the LEDs 102-104 are adjusted accordingly to minimize the difference between the desired color and brightness and the "real" color and brightness. If the difference is greater than a second threshold, which is higher than the first threshold, it might be necessary to also select a different drive current level. In this case, it might be necessary to recalculate the luminous flux weight ratio for the illumination system 100. Furthermore, for the minimization of the difference, for instance a proportional integral-derivative (PID) controller might be used. As understood by the skilled addressee, in the case that the light sensing unit 107 is a passive component it might be activated at all time, and the controller 105 will "sample" the light sensing unit 107 at predetermined time intervals. The adjustments of the duty cycles and if necessary the determination of different drive currents may be repeated at suitable time intervals (for example once a minute or once an hour) to compensate for change in surrounding temperature, substrate temperature, and aging. The surrounding and/or substrate temperature is in this case provided by means of the temperature sensor 108. The temperature sensor is used to measure a temperature (heatsink temperature, ambient temperature), which is either directly used, or used to calculate an estimated LED junction temperature. The derived temperature is then used to estimate the flux output of the differently colored LEDs, and/or to estimate its color points: these are then used in a feed forward color control system to correct the LED drive duty cycles. Without a flux sensor present, it is used for at least flux estimation and optionally also LED color point estimation. However, when also a flux sensor is used, the temperature sensor can used to estimate the color point shifts. Any combinations of temperature sensors, flux sensors, and color sensors can be used.

An example of a preferred control system is disclosed in "Color tunable LED spot lighting", by C. Hoelen et. al., presented at the SPIE conference 2006.

Figure 4:
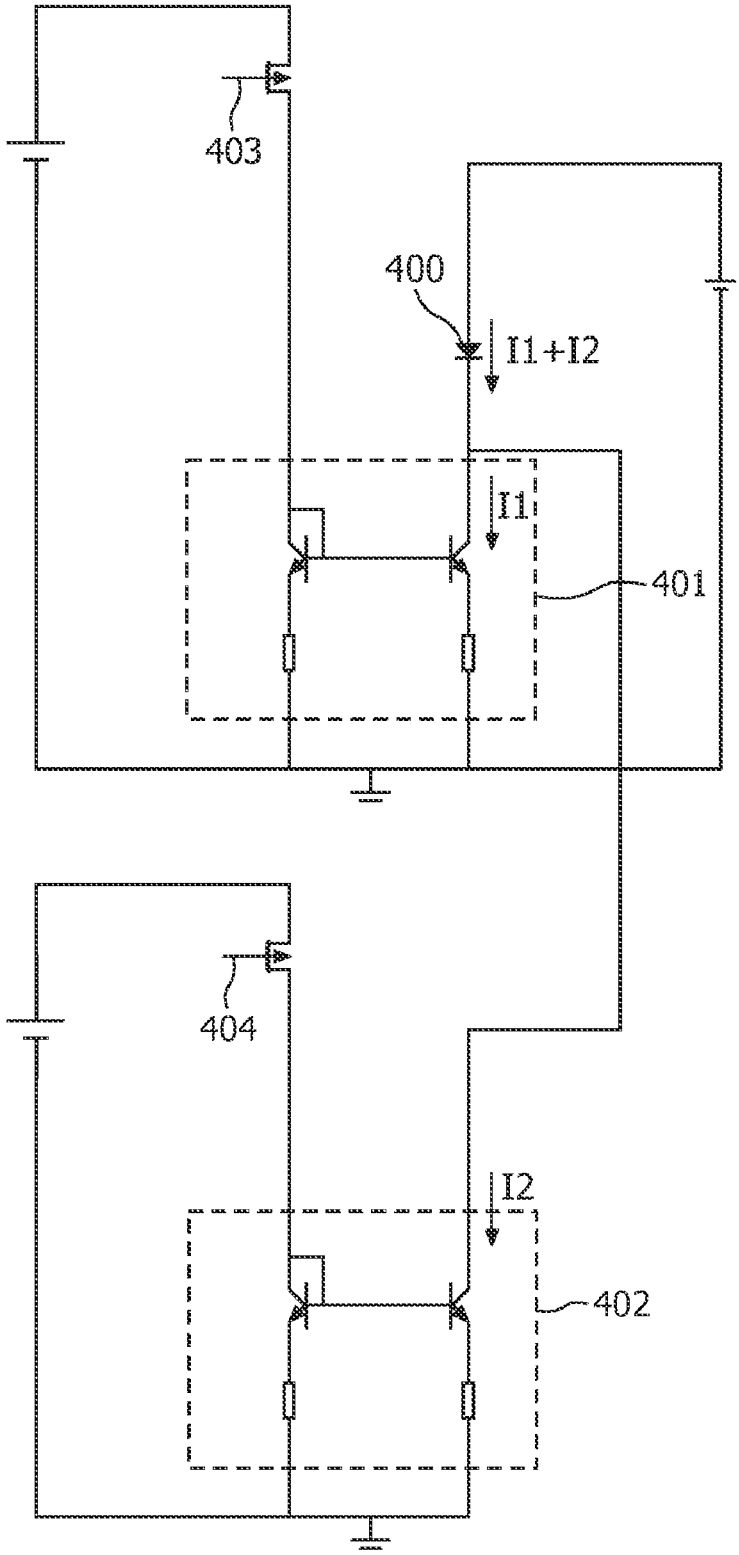
FIG. 4 is a circuit diagram illustrating a preferred implementation of two current mirrors for providing a plurality of different drive currents.

In FIG. 4, a circuit diagram comprising two current mirrors, 401, 402, for providing a plurality of different drive currents to a LED 400 is shown. The LED 400 may be one of the LEDs 102-104 in FIG. 1. Each of the current mirrors 401, 402 have individual PWM-inputs 403, 404, respectively. The current mirrors 401, 402 each produces a current I1, I2, which ads up in the LED 400 such that the current level through the LED 400 can be 0, I1, I2, or I1+I2 depending on the PWM-inputs 403, 404. The PWM-inputs 403, 404 are used for both pulse width modulation as well as pulse amplitude modulation, according to the above described method for driving a plurality of LEDs comprised in a lighting device at multiple current amplitude levels at the above determined duty cycles.

The skilled addressee realizes that the present invention by no means is limited to the preferred embodiments described above. On the contrary, many modifications and variations are possible within the scope of the appended claims. For example, although mixtures of red, green and blue have been proposed for light due to their ability to create a wide gamut of additively mixed colors, the general color quality or color rendering capability of such systems are not ideal for all applications. This is primarily due to the narrow bandwidth of current red, green and blue emitters. However, wider band sources do make possible good color rendering, as measured, for example, by the standard CRI index. In some cases this may require LED spectral outputs that are not currently available. However, it is known that wider-band sources of light will become available, and such wider-band sources are encompassed as sources for lighting devices described herein.

For backlight applications for displays, important performance parameters are power consumption, white point value and variation, and color gamut (triangle size): for high-end TV and monitor applications, red, green and blue LEDs are preferred, either narrow-banded direct-emitters or phosphor-converted sources.

For general lighting illumination applications, the size of the color triangle is less important, but color rendering is. In that case, use of wide-band (phosphor-converted) white LEDs can be used together with narrow-banded red, green or blue LEDs to make the color point adjustable. It is also possible to use an amber (A) LED next to red, green and blue LEDs to improve the color rendering performance.

The invention claimed is:

1. Method for determining drive values for driving a lighting device at a desired brightness and color, said lighting device comprising of a plurality of light emitting diodes (LEDs) of at least two different colors, said method comprising the steps of:

determining a first luminous flux weight ratio based on the desired color and a first drive current for driving each of the differently colored LEDs;

determining a first luminous flux for each of the differently colored LEDs based on the desired brightness and the first luminous flux weight ratio;

comparing, for each of the differently colored LEDs, the first luminous flux with a nominal luminous flux for a plurality of different drive currents;

selecting, for each of the differently colored LEDs, a preferred drive current that at least can produce the first luminous flux;

determining a second luminous flux weight ratio based on the desired color and the selected drive currents for each of the differently colored LEDs;

determining a second luminous flux for each of the differently colored LEDs based on the desired brightness and the second luminous flux weight ratio; and determining a duty cycle for each of the differently colored LEDs at the selected drive currents, wherein the selected currents at the determined duty cycles produces the second luminous flux for each of the differently colored LEDs.

2. Method according to claim 1, further comprising the step of driving each of the differently colored LEDs with the selected currents at the determined duty cycles.

3. Method according to claim 2, further comprising the steps of:

acquiring measurement values by means of a temperature sensor mounted in proximity to the differently colored LEDs;

determining a luminous flux and color for each of the differently colored LEDs based on said measurement values;

determining a brightness and color for the lighting device based on said determined luminous fluxes and colors; and adjusting the drive currents and the duty cycles for each of said differently colored LEDs based on a difference between said desired brightness and color and the determined brightness and color such that the lighting device emits light at the desired brightness and color.

4. Method according to claim 2, further comprising the steps of:

acquiring measurement values by means of a light sensing unit;

determining a brightness and color for the lighting device based on said measurement values; and adjusting at least one of the drive currents and the duty cycles for each of said differently colored LEDs based on a difference between the desired brightness and color and the determined brightness and color such that the lighting device emits light at the desired brightness and color.

5. Method according to claim 1, wherein the plurality of different drive currents for driving each of the differently colored LEDs are provided by:

activating a first current source to generate a first drive signal having a first amplitude;

activating a second current source to generate a second drive having a second amplitude;

adding the first drive signal to the second drive signal, thereby generating a composite drive signal; and providing the composite drive signal to each of the differently colored LEDs, wherein the composite drive signal can assume one out of four different amplitudes based on if one, both, or none of the current sources are activated.

6. A method according to claim 5, wherein the second amplitude is lower than the first amplitude.

7. A method according to claim 5, wherein the first and the second current sources are activated by means of individual pulse width modulated signals.

8. A driver for determining drive values for driving a lighting device at a desired brightness and color, said lighting device comprising of a plurality of light emitting diodes (LEDs) of at least two different colors, said driver comprising:

means for determining a first luminous flux weight ratio based on the desired color and a first drive current for driving each of the differently colored LEDs;

means for determining a first luminous flux for each of the differently colored LEDs based on the desired brightness and the first luminous flux weight ratio;

means for comparing, for each of the differently colored LEDs, the first luminous flux with a nominal luminous flux for a plurality of different drive currents;

means for selecting, for each of the differently colored LEDs, a preferred drive current that at least can produce the first luminous flux;

means for determining a second luminous flux weight ratio based on the desired color and the selected drive currents for each of the differently colored LEDs;

means for determining a second luminous flux for each of the differently colored LEDs based on the desired brightness and the second luminous flux weight ratio; and means for determining a duty cycle for each of the differently colored LEDs at the selected drive currents, wherein the selected currents at the determined duty cycles produces the second luminous flux for each of the differently colored LEDs.

9. A driver according to claim 8, further comprising means for driving each of the differently colored LEDs with the selected currents at the determined duty cycles.

10. A driver according to claim 8, wherein the plurality of different drive currents for driving each of the differently colored LEDs are provided by:

a first current source adapted to receive an activation signal and to generate a first drive signal having a first amplitude;

a second current source adapted to receive an activation signal and to generate a second drive signal having a second amplitude;

an adder for adding the first drive signal to the second drive signal, thereby generating a composite drive signal; and means for providing the composite drive signal to each of the differently colored LEDs, wherein the composite drive signal can assume one out of four different amplitudes based on if one, both, or none of the current sources are activated.

11. A lighting device comprising:

plurality of LEDs of at least two colors; and driver according to claim 8 for driving each of the differently colored LEDs such that the lighting device emits light at a desired brightness and color.

12. display unit, comprising:

display panel;

backlight comprising a lighting device comprising of a plurality of differently colored LEDs; and driver according to claim 8 for driving each of the differently colored LEDs such that the lighting device emits light at a desired brightness and color.

* * * * *